US008393919B2

(12) United States Patent
Islam et al.

(10) Patent No.: US 8,393,919 B2
(45) Date of Patent: Mar. 12, 2013

(54) UNPREPARED CABLE END COAXIAL CONNECTOR

(75) Inventors: Nahid Islam, Westmont, IL (US); Al Cox, Orland Park, IL (US)

(73) Assignee: Andrew LLC, Hickory, NC (US)

( * ) Notice: Subject to any disclaimer, the term of this patent is extended or adjusted under 35 U.S.C. 154(b) by 0 days.

(21) Appl. No.: 13/321,612

(22) PCT Filed: Jun. 4, 2010

(86) PCT No.: PCT/US2010/037512

§ 371 (c)(1),
(2), (4) Date: Nov. 21, 2011

(87) PCT Pub. No.: WO2010/141898

PCT Pub. Date: Dec. 9, 2010

(65) Prior Publication Data

US 2012/0064767 A1 Mar. 15, 2012

Related U.S. Application Data

(60) Provisional application No. 61/184,573, filed on Jun. 5, 2009.

(51) Int. Cl.
*H01R 9/05* (2006.01)

(52) U.S. Cl. ..... 439/584

(58) Field of Classification Search ..... 439/578, 439/583, 584

See application file for complete search history.

(56) References Cited

U.S. PATENT DOCUMENTS 3,764,959 A 10/1973 Toma et al.
3,963,320 A 6/1976 Spinner
4,824,400 A 4/1989 Spinner
6,133,532 A * 10/2000 Lundback et al. ..... 174/88 C
6,793,529 B1 * 9/2004 Buenz ..... 439/583
6,882,242 B2 * 4/2005 Nelson ..... 333/35
6,893,290 B2 * 5/2005 Buenz et al. ..... 439/578
6,926,555 B2 * 8/2005 Nelson ..... 439/578
6,976,872 B1 * 12/2005 Wild et al. ..... 439/578
6,994,587 B2 * 2/2006 Buenz et al. ..... 439/578
7,347,727 B2 3/2008 Wlos et al.
7,435,135 B2 * 10/2008 Wlos ..... 439/584
7,448,906 B1 * 11/2008 Islam ..... 439/578
7,690,945 B2 * 4/2010 Petersen ..... 439/584
7,731,529 B1 * 6/2010 Islam ..... 439/583
7,803,018 B1 * 9/2010 Islam ..... 439/583
8,288,667 B2 * 10/2012 Chiou ..... 174/652
8,323,056 B2 * 12/2012 Clausen ..... 439/584
2005/0017828 A1 * 1/2005 Buenz et al. ..... 333/260
2005/0020129 A1 * 1/2005 Dykstra et al. ..... 439/578
2005/0026496 A1 * 2/2005 Islam et al. ..... 439/578
2005/0079761 A1 * 4/2005 Rodrigues ..... 439/578
2005/0161246 A1 7/2005 Khemakhem et al.
2006/0014427 A1 * 1/2006 Islam et al. ..... 439/578
2009/0053931 A1 2/2009 Islam
2009/0130900 A1 * 5/2009 Petersen ..... 439/578
2010/0041271 A1 * 2/2010 Van Swearingen et al. .. 439/583

(Continued)

*Primary Examiner* — Ross Gushi
(74) *Attorney, Agent, or Firm* — Babcock IP, PLLC

(57) ABSTRACT

A coaxial connector provided with an increasing diameter compression sidewalk A grip ring is seated within the coupling body bore and is provided with a plurality of coupling spring fingers extending from the grip ring. An inner diameter of the coupling spring fingers has a grip surface and an inward projecting cable stop is provided at a connector end of the grip ring. The connector body and the coupling body are coupled together via threads, the grip ring dimensioned for axial advancement of the coupling body along the threads to drive the coupling spring fingers against the compression sidewall to exert a compression force radially inward upon the outer diameter of the outer conductor seated in the coupling body bore abutting the cable stop.

20 Claims, 13 Drawing Sheets

U.S. PATENT DOCUMENTS

| | | | | |
|---|---|---|---|---|
| 2010/0178800 | A1* | 7/2010 | Clausen | 439/583 |
| 2011/0003507 | A1* | 1/2011 | Van Swearingen et al. | 439/578 |
| 2011/0021074 | A1* | 1/2011 | Paynter et al. | 439/584 |
| 2011/0244722 | A1* | 10/2011 | Chawgo et al. | 439/578 |
| 2012/0064764 | A1* | 3/2012 | Islam | 439/578 |
| 2012/0064767 | A1* | 3/2012 | Islam et al. | 439/583 |
| 2012/0064768 | A1* | 3/2012 | Islam et al. | 439/585 |
| 2012/0149239 | A1* | 6/2012 | Clausen | 439/584 |

* cited by examiner

UNPREPARED CABLE END COAXIAL CONNECTOR

CROSS REFERENCE TO RELATED APPLICATIONS

This application claims the benefit of U.S. Provisional Patent Application Ser. No. 61/184,573 "Coaxial Connector for Solid Outer Conductor Coaxial Cable" filed Jun. 5, 2009 by Nahid Islam and Al Cox, currently pending and hereby incorporated by reference in its entirety.

BACKGROUND OF THE INVENTION

1. Field of the Invention

The invention relates to electrical connectors for coaxial cable. More particularly the invention relates to a coaxial connector with an outer conductor outer diameter gripping electro-mechanical interconnection suitable for coaxial cables with an unprepared cable end.

2. Description of Related Art

A positive stop type coaxial connector, for example as disclosed in commonly owned U.S. Utility Pat. No. 6,793,529 titled: "Coaxial Connector with Positive Stop Clamping Nut Attachment", by Larry Buenz, issued Sep. 21, 2004, hereby incorporated by reference in its entirety, has a connector body and a back nut configured for threaded interconnection. As the connector body and back nut are threaded together, a flared leading edge of the outer conductor of the coaxial cable is clamped between the connector body and the coupling body in a secure electro-mechanical interconnection. To indicate proper threading completion and avoid damage to the connector and/or coaxial cable from over-tightening, a positive stop between the connector body and the back body may be applied wherein the threading between the back body and connector body bottoms at a specific axial location at which the desired maximum tightening compression/torque force occurs, definitively signaling the installer that the proper amount of tightening has been reached. To allow for thermal expansion cycling and/or variances in manufacture of the connector and/or the outer conductor dimensions, a compression element is inserted between internal contacting surfaces of the outer conductor, back body and/or the connector body. The compression element is typically supplied loose with the coaxial connector prior to installation, which creates a loss and/or damage risk for the compression element.

Prior positive stop type coaxial connector designs typically require flaring of the outer conductor to facilitate a clamp electro-mechanical interconnection between the connector body, the leading edge of the outer conductor and the back nut. Prior to installation, a coaxial cable must be specially prepared for a clamp type interconnection, to remove dielectric material and/or adhesive from the inner diameter of the outer conductor. Such cable end preparations typically require each installer to have on hand a specialized cable dielectric coring/stripping tool.

A current market trend is to replace traditional copper material coaxial cables with aluminum material coaxial cables to save materials cost and lower the weight per unit length of the coaxial cable. Further, smooth wall outer conductor cables provide inherent materials cost and cable weight advantages compared to corrugated outer conductor coaxial cable configurations.

Aluminum has lower mechanical strength properties including cold work properties (bending) compared to copper. Aluminum is susceptible to creep and may weaken at a single contact point with extreme contact pressure due to bending, pulling and/or twisting.

Smooth wall cable is less flexible compared to corrugated cable; however, users used to working with corrugated coaxial cable may not recognize the lower bend capability of smooth wall cable. Users attempting to apply improper bend radii may overstress a conventional coaxial connector and cable interconnection.

Competition within the coaxial cable and connector industry has focused attention upon improving electrical performance as well as reducing manufacturing, materials and installation costs.

Therefore, it is an object of the invention to provide a method and apparatus that overcomes deficiencies in such prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention. For clarity, similar elements between different embodiments utilize the same notations and some notations appearing on the different figures may not be specifically identified on each figure.

DETAILED DESCRIPTION

One skilled in the art will appreciate that the connector end 1 and the cable end 3 are descriptors used herein to clarify longitudinal locations and/or contacting interrelationships between the various elements of the coaxial connector(s). In addition to the identified positions in relation to adjacent elements along the coaxial connector 5 longitudinal axis, each individual element has a connector end side and a cable end side, i.e. the sides of the respective element that are facing the respective connector end 1 and the cable end 3 of the coaxial connector 5.

Figure 1:
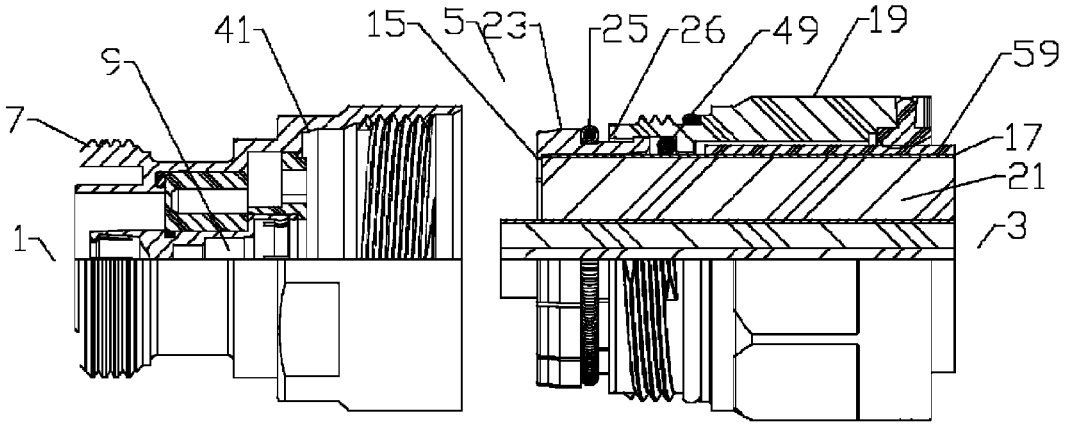
FIG. 1 is a schematic 90 degree cut-away side view of a first embodiment of a coaxial connector, with a coaxial cable inserted into coupling body, ready for coupling with connector body.

A first embodiment of a coaxial connector, as shown in FIGS. 1-5, includes a connector body 7 provided with a connector body bore 9. As best shown in FIG. 1, a compression sidewall 41 provided in the connector body bore has an increasing diameter towards the cable end 3. A coupling body 19 provided with a coupling body bore 21 is coupled to the connector body 7 via thread(s) 47.

Figure 2:
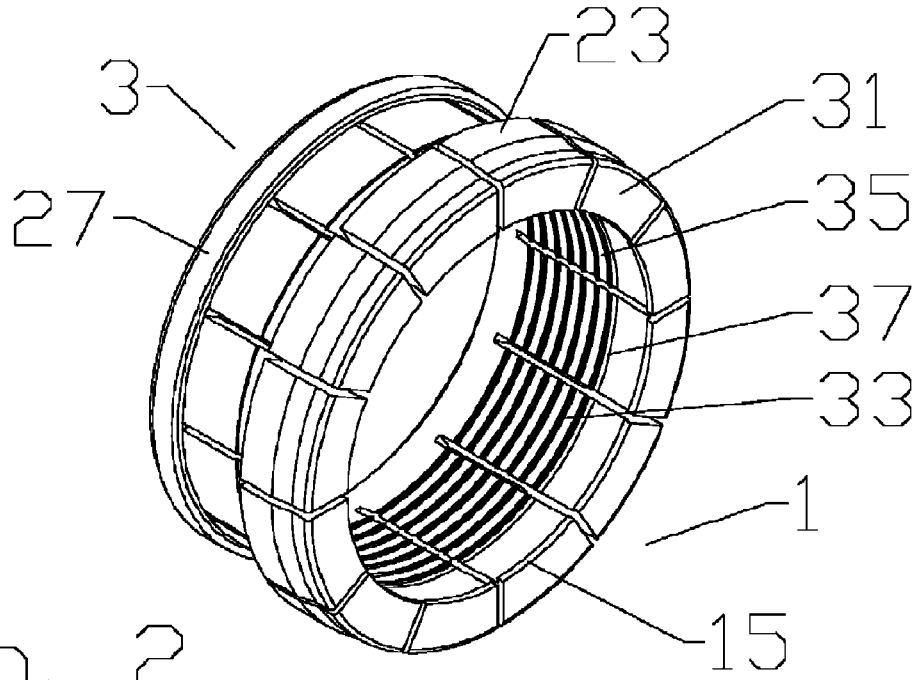
FIG. 2 is a schematic isometric view of a grip ring.
Figure 3:
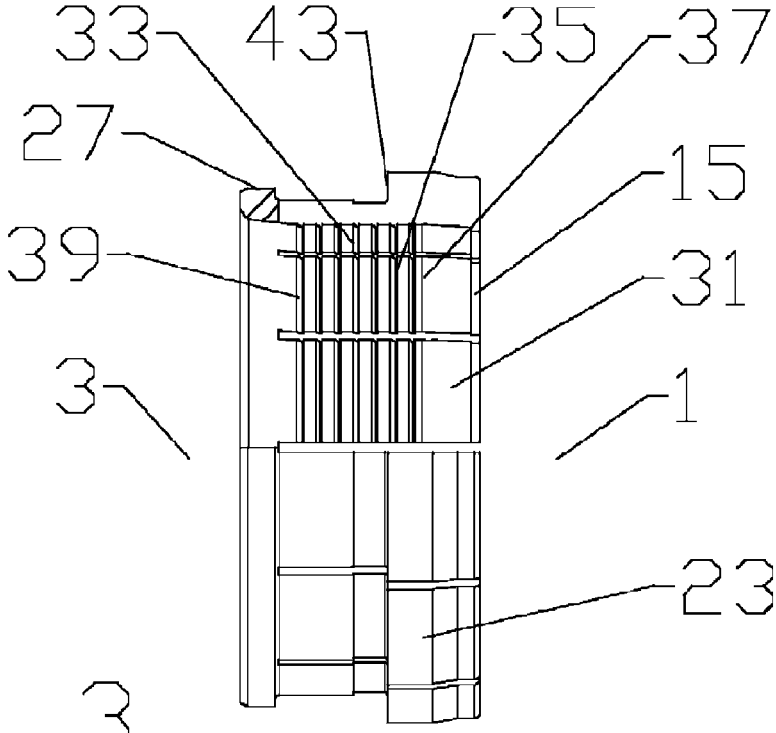
FIG. 3 is a schematic 90 degree cut-away side view of FIG. 2.

A grip ring 23, best shown in FIGS. 2 and 3, is seated within the coupling body bore 21. The grip ring 23 is dimensioned to receive the end of the outer conductor 17 therethrough until it abuts an inward projecting cable stop 15 at the connector end 1 of the grip ring 23.

The grip ring 23 is provided with a plurality of coupling spring finger(s) 31 extending towards the connector end 1, an inner diameter of the coupling spring finger(s) 31 provided with a grip surface 33. The grip surface 33 may be formed as a plurality of annular barb(s) 35, for example with each of the barb(s) 35 provided with a stop surface 37 at a connector end side and an insertion surface 39 at a cable end side, the stop surface 37 provided normal to a longitudinal axis and the insertion surface 39 angled towards the connector end 1. Thereby, the outer conductor 17 may be inserted past the barb(s) 35, spreading the coupling spring finger(s) 31 outward and sliding over the angled insertion surface(s) 39 toward the connector end 1, but the stop surface(s) 37 will bite into and grip the outer diameter surface of the outer conductor 17 if movement toward the cable end 3 is attempted. Alternatively, the grip surface 33 may be formed, for example, as a helical thread.

An annular compression body 25, for example a helical coil spring, may be seated on an outer diameter of the grip ring 23 between a compression surface 26 of the coupling body 19 and an upward projecting compression body shoulder 43 of the grip ring 23. A washer 57 may be applied between the compression body 25 and the compression surface 26 to reduce fouling during threading between the coupling body 19 and the connector body 7

As best shown in FIG. 1, the grip ring 23 may be retained coupled to the coupling body 19 by an outward projecting coupling shoulder 27 at the cable end 3 of grip ring 23 seated within an annular retention groove 29 of the coupling body bore 21.

As the coupling body 19 and connector body 7 are threaded together, the compression surface 26 drives the compression body 25 into the compression body shoulder 43 and thereby the coupling spring finger(s) 31 against the compression sidewall 41 to exert a compression force radially inward upon the outer diameter of the outer conductor 17 seated in the coupling body bore 21 abutting the cable stop 15.

Figure 4:
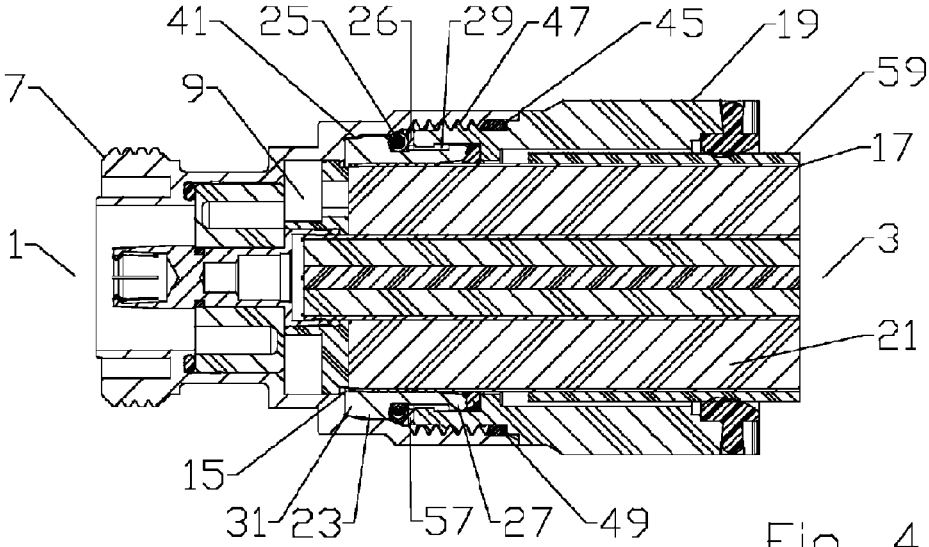
FIG. 4 is a schematic cut-away side view of the coaxial connector of FIG. 1, attached to the coaxial cable.
Figure 5:
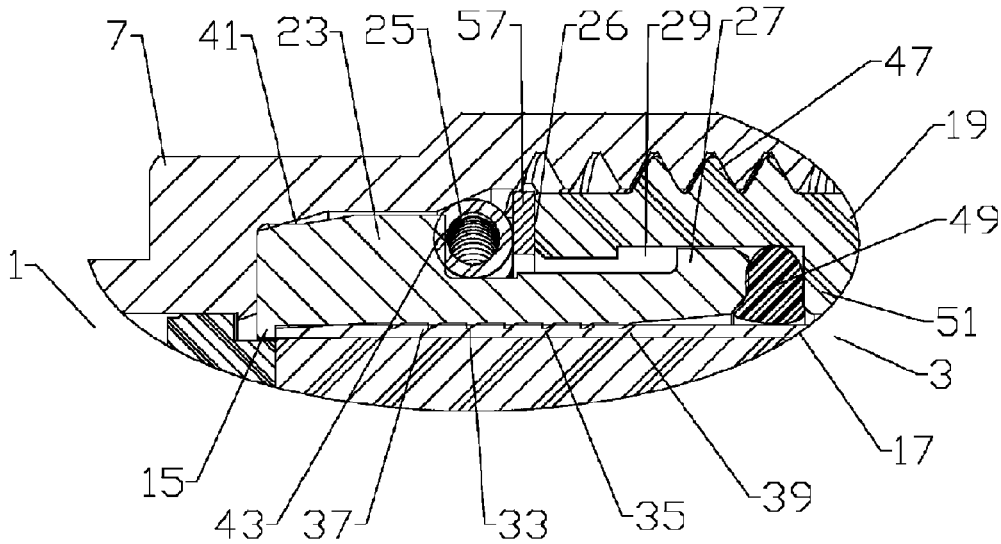
FIG. 5 is a close-up view of FIG. 4.
Figure 6:
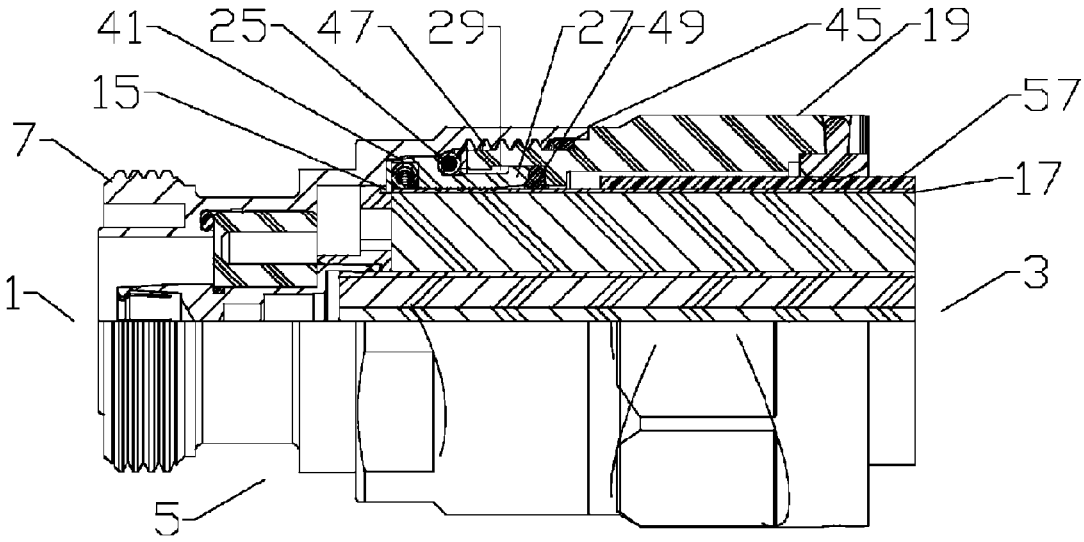
FIG. 6 is a schematic 90 degree cut-away side view of a second embodiment of a coaxial connector, attached to a coaxial cable.
Figure 7:
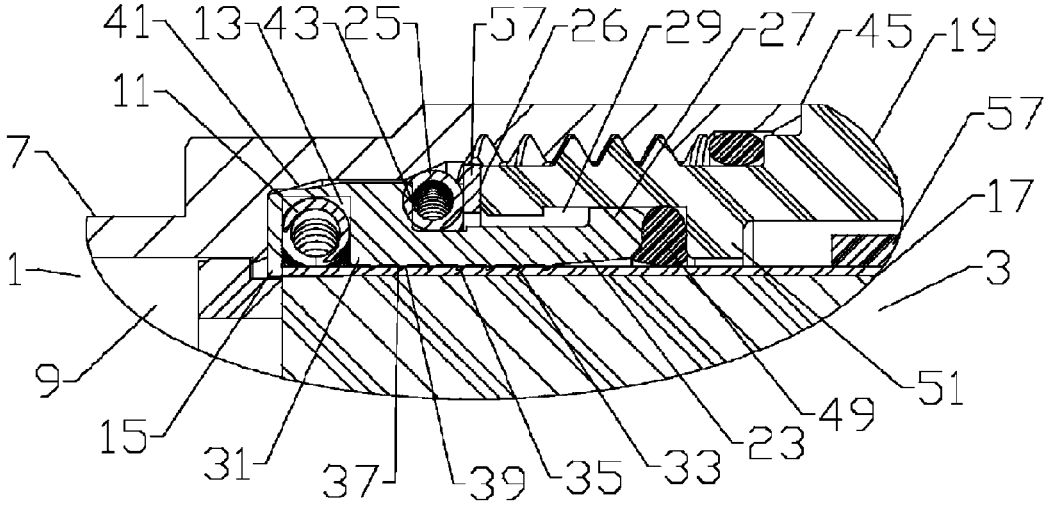
FIG. 7 is a close-up view of FIG. 7.
Figure 8:
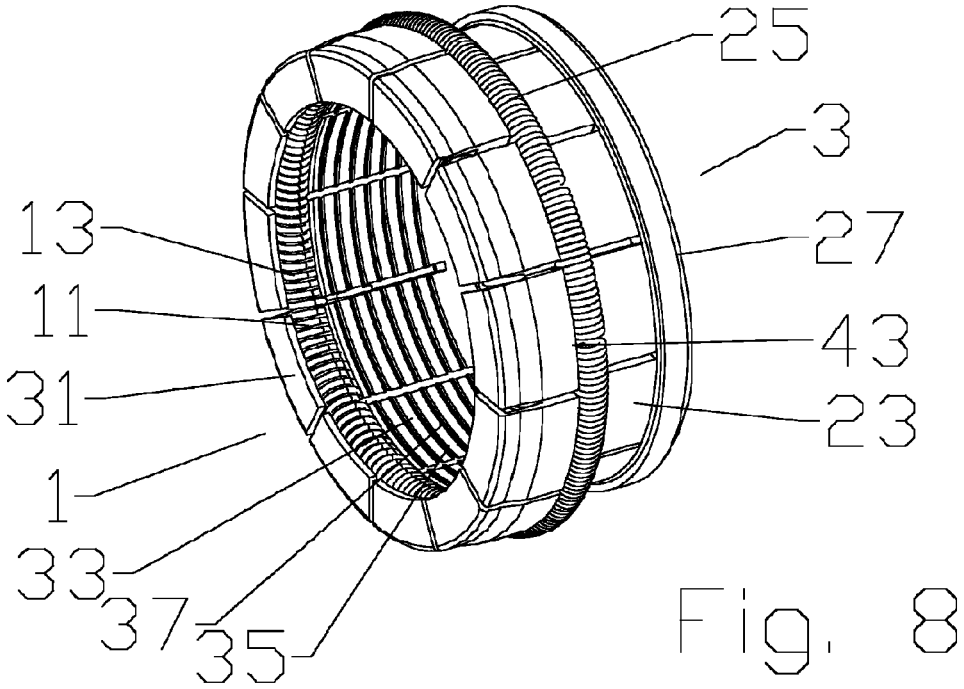
FIG. 8 schematic isometric view of a second embodiment of a grip ring, with coupling body and spring contact mounted thereon.
Figure 9:
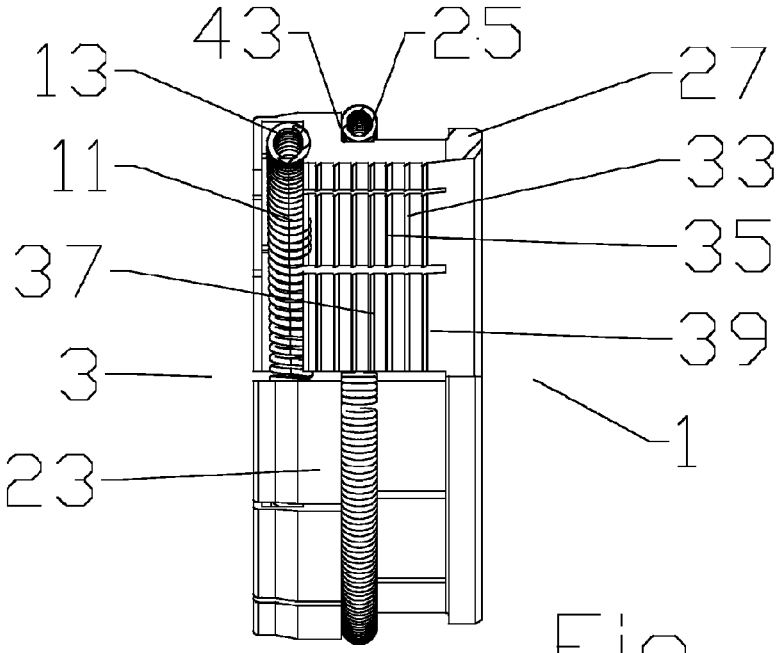
FIG. 9 is a schematic cut-away side view of FIG. 8.
Figure 10:
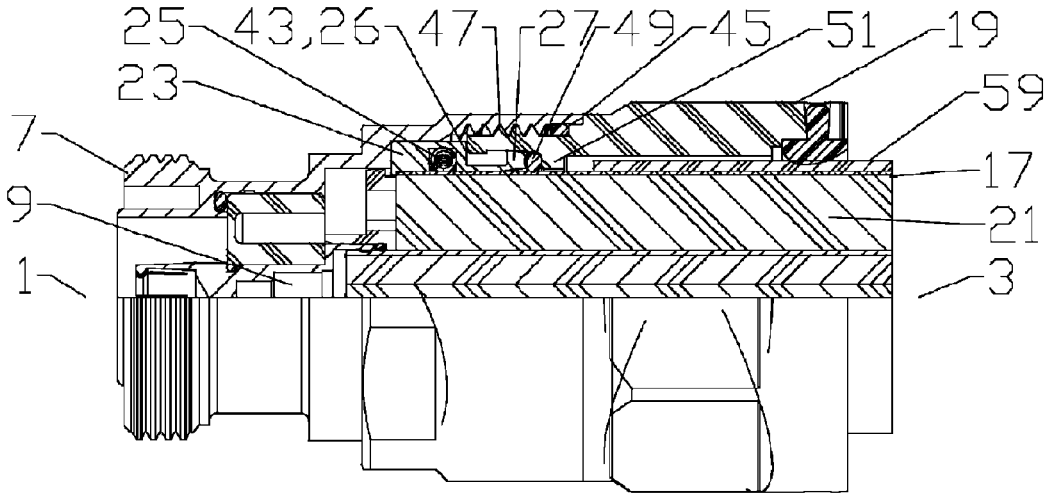
FIG. 10 is a schematic 90 degree cut-away side view of a third embodiment of a coaxial connector, attached to a coaxial cable.
Figure 11:
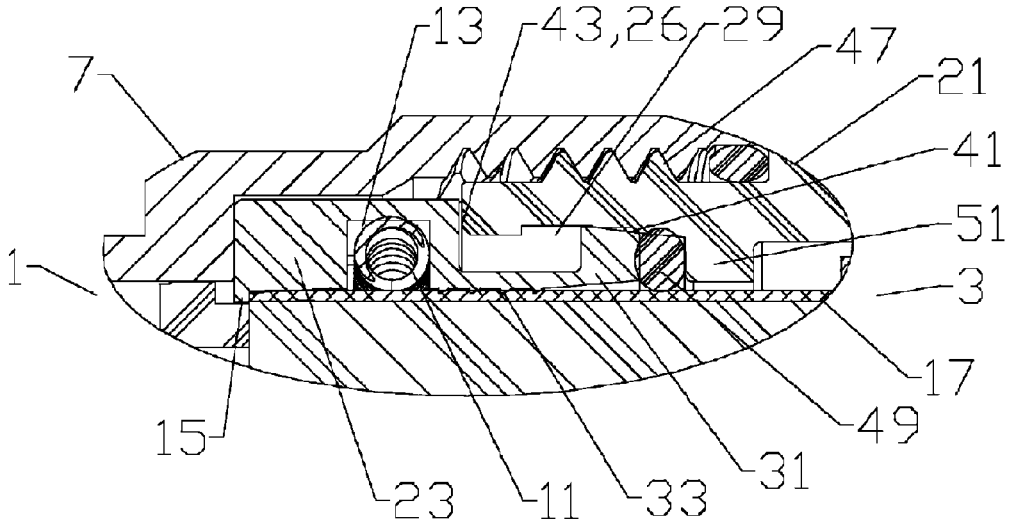
FIG. 11 is a close up view of FIG. 10.
Figure 12:
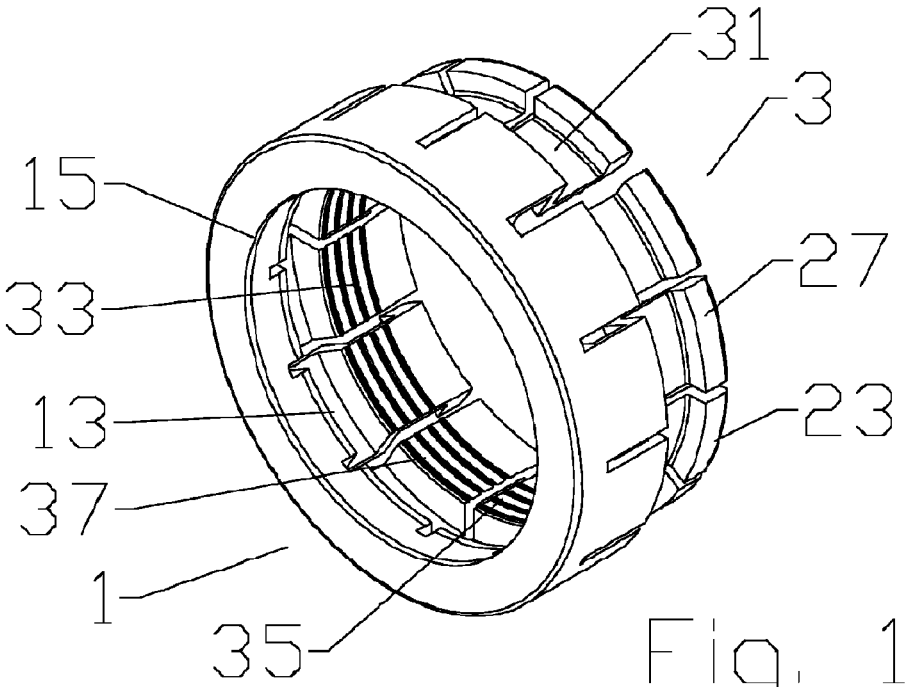
FIG. 12 is a schematic isometric view of a third embodiment of a grip ring.
Figure 13:
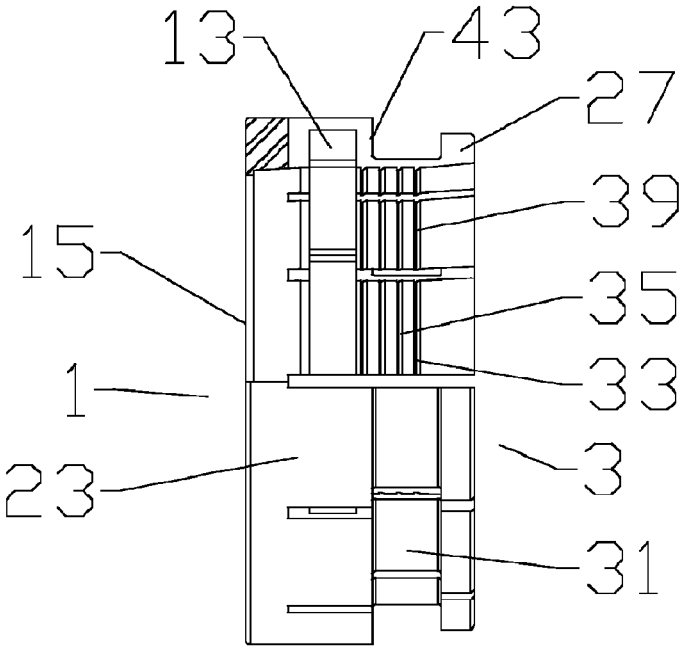
FIG. 13 is a schematic 90 degree cut-away side view of FIG. 12.
Figure 14:
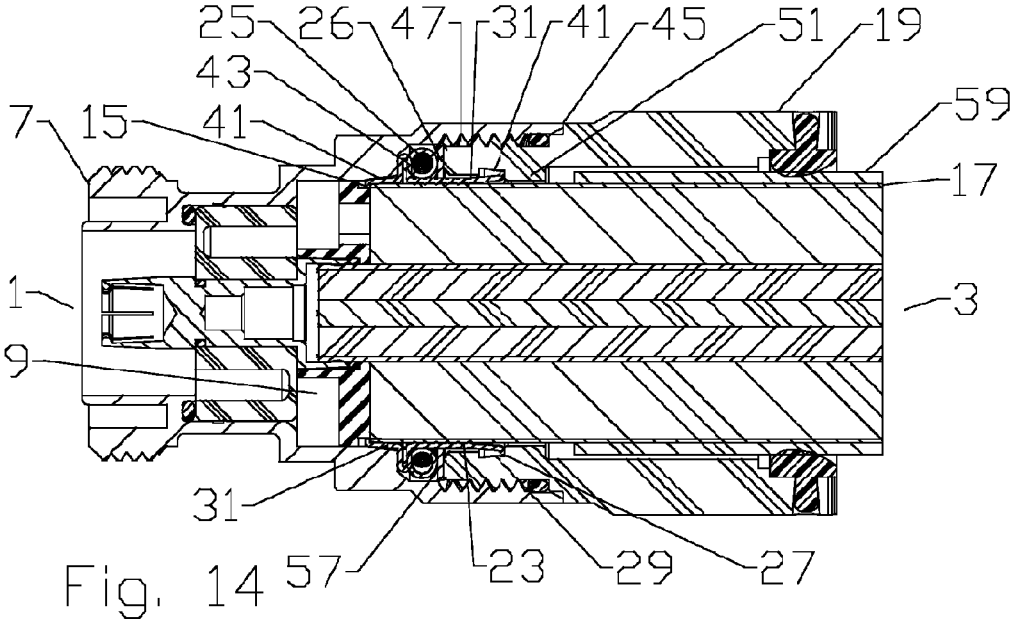
FIG. 14 is a schematic cut-away side view of a fourth embodiment of a coaxial connector, attached to a coaxial cable.
Figure 15:
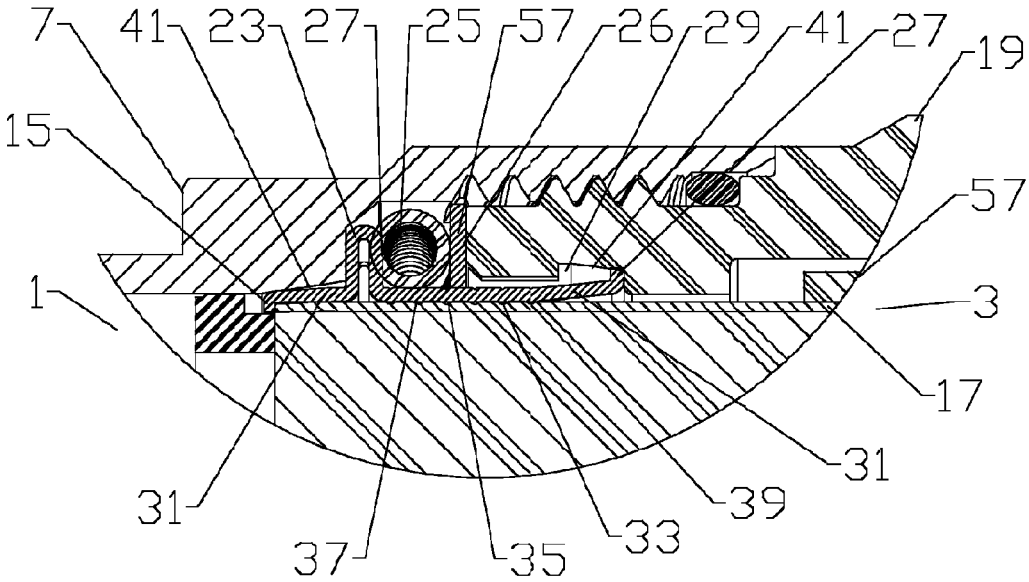
FIG. 15 is a close-up view of FIG. 14.

The grip surface 33, driven into the outer diameter of the outer conductor 17, and the uniform circumferential radially inward compression force provide a secure electromechanical interconnection between the outer conductor 17 and the connector body 7, best shown in FIGS. 4 and 5.

An axial play between the coupling shoulder 27 and the retention groove 29 of the coupling body 19 may be utilized to compress a gasket 49 seated between a cable end 3 of the grip ring 23 and an inward projecting gasket shoulder 51 of the coupling body bore 21. Thereby, the outer conductor 17 may be easily inserted through the gasket 49 while in an uncompressed state and then, as the coupling body 19 is advanced towards the connector body 7, the grip ring 23 is driven towards the cable end 3 of the retention groove 29, which compresses the gasket 49 against the gasket shoulder 51, deforming it radially inward into secure sealing engagement with the outer diameter of the outer conductor 17 (FIG. 5).

The radially inward compression force generated by the radial inward displacement of the coupling spring finger(s) 31 during may be limited by the application of a surface to surface positive stop 45 (FIG. 4) between the coupling body 19 and the connector body 7 that stops the compression force at a predetermined maximum torque by preventing further movement (threading) of the coupling body 19 toward the connector body 7 once the specific preselected axial positioning between the coupling body 19 and the connector body 7 which is known to generate the desired maximum torque is reached.

The threading between the connector body 7 and the coupling body 19, best shown in FIG. 1, may be applied as multiple interleaved thread(s) 47, for example four interleaved threads, increasing the thread pitch to significantly reduce the number of rotations required to advance the coupling body 19 to the positive stop 45 engagement with the connector body 7, without unacceptably reducing the strength characteristics of the resulting threaded interconnection.

In further embodiments, for example as shown in FIGS. 6-9, a circumferential uniformity of the contact between the grip ring 23 and the outer diameter of the outer conductor 17, proximate the outer conductor end, may be enhanced for reduction of IMD and/or RF leakage by the addition of a spring contact 11, for example a helical coil spring, seated in a spring contact groove 13 provided in the inner diameter of the coupling spring finger(s) 31; the spring contact dimensioned to bias against the outer diameter of the outer conductor.

One skilled in the art will appreciate that the grip ring configuration may be reversed in alternative embodiments, for example as shown in FIGS. 10-13, so that the coupling spring finger(s) extend towards the cable end 3, biased radially inward during axial movement of the coupling body 19 towards the connector body 7 by contact with a compression sidewall 41 of the coupling body 19 with a diameter decreasing toward the cable end 3. The compression sidewall 41 provided as the bottom of the retention groove 29.

The grip ring 23 has been demonstrated as a machined element. Alternatively, for example as shown in FIGS. 14-19, the grip ring 23 may be cost effectively formed using stamping and rolling manufacturing techniques. An interleaved coupling spring finger configuration, best shown in FIGS. 16 and 17, applies coupling spring finger(s) 31 extending toward both the cable end 3 and the connector end 1. Thereby, a compression sidewall 41 may be utilized at both the cable end coupling body bore 21 and the connector end connector body bore contact points of the grip ring 23.

Figure 18:
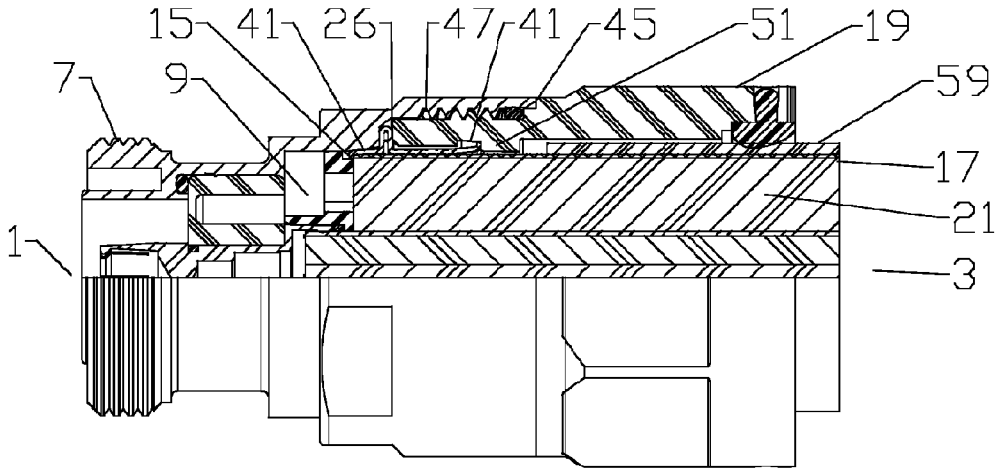
FIG. 18 is a schematic 90 degree cut-away side view of a fifth embodiment of a coaxial connector, attached to a coaxial cable.
Figure 19:
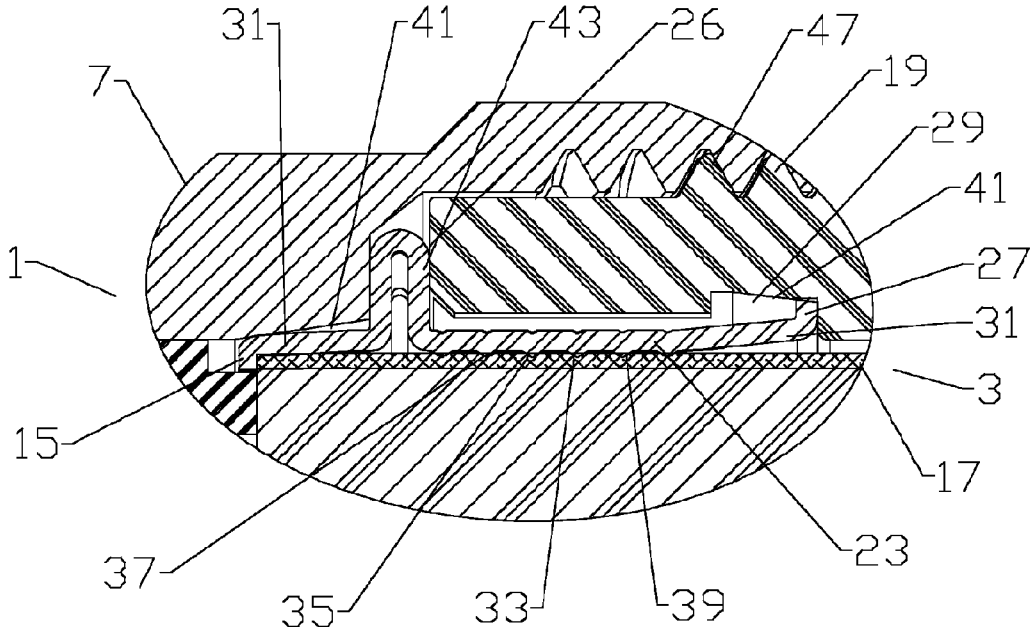
FIG. 19 is a close-up view of FIG. 18.
Figure 20:
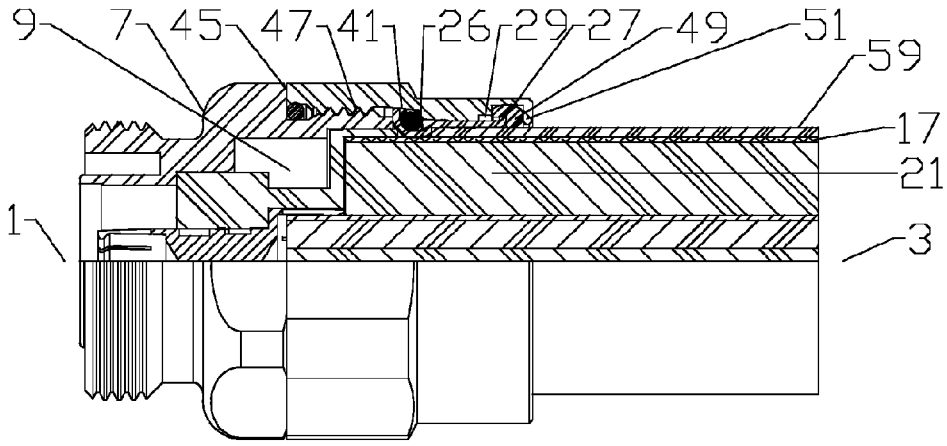
FIG. 20 is a 90 degree cut-away side view of a sixth embodiment of a coaxial connector, attached to a coaxial cable.
Figure 21:
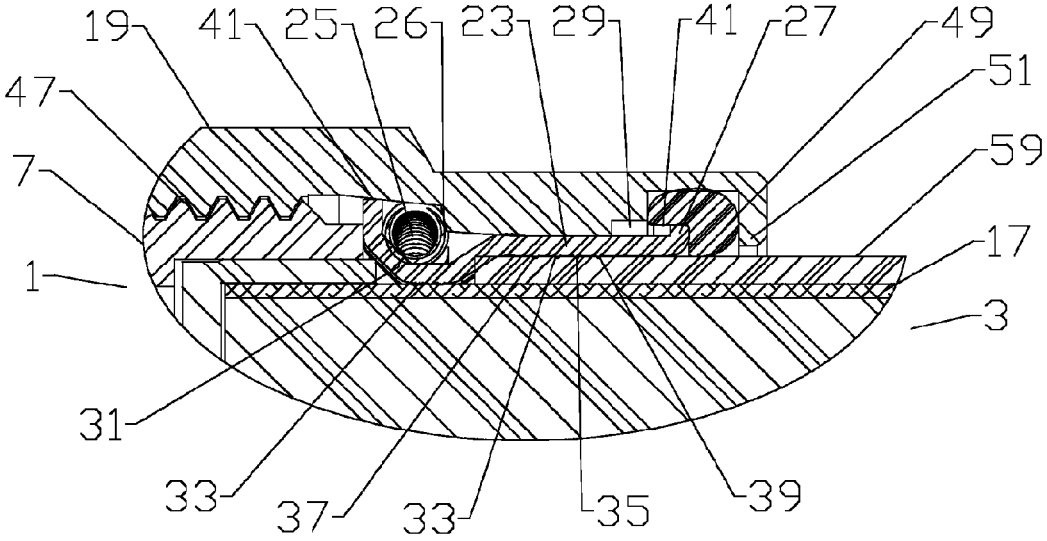
FIG. 21 is a close-up view of FIG. 20.
Figure 22:
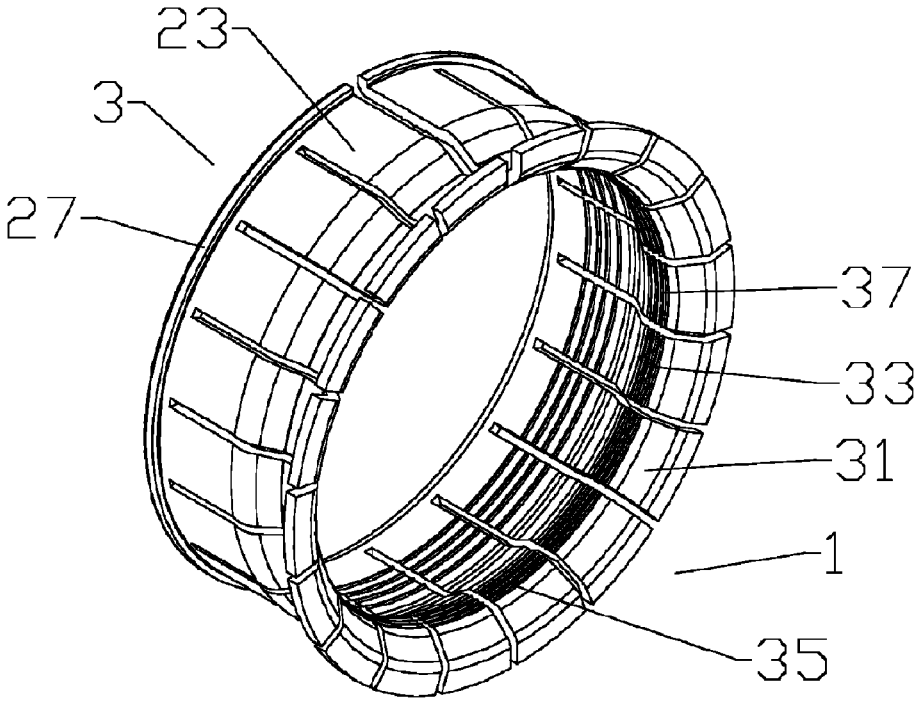
FIG. 22 is a schematic isometric view of a sixth embodiment of a grip ring.
Figure 23:
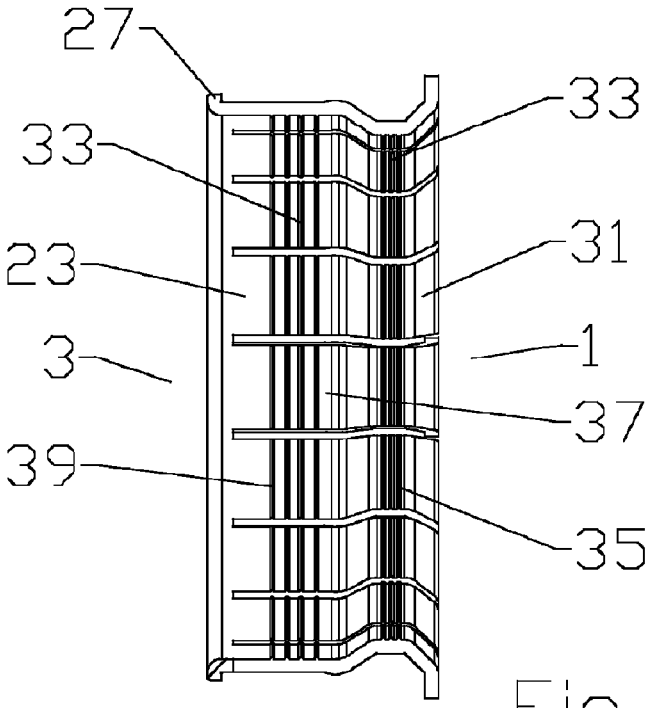
FIG. 23 is a schematic cut-away side view of FIG. 22.

With the coupling shoulder 27 formed as a U-bend of the grip ring 23, depending upon the material characteristics of the grip ring 23, the functionality of the compression body 25 may be integrated into the grip ring 23, for example as demonstrated in FIGS. 18 and 19.

Figure 16:
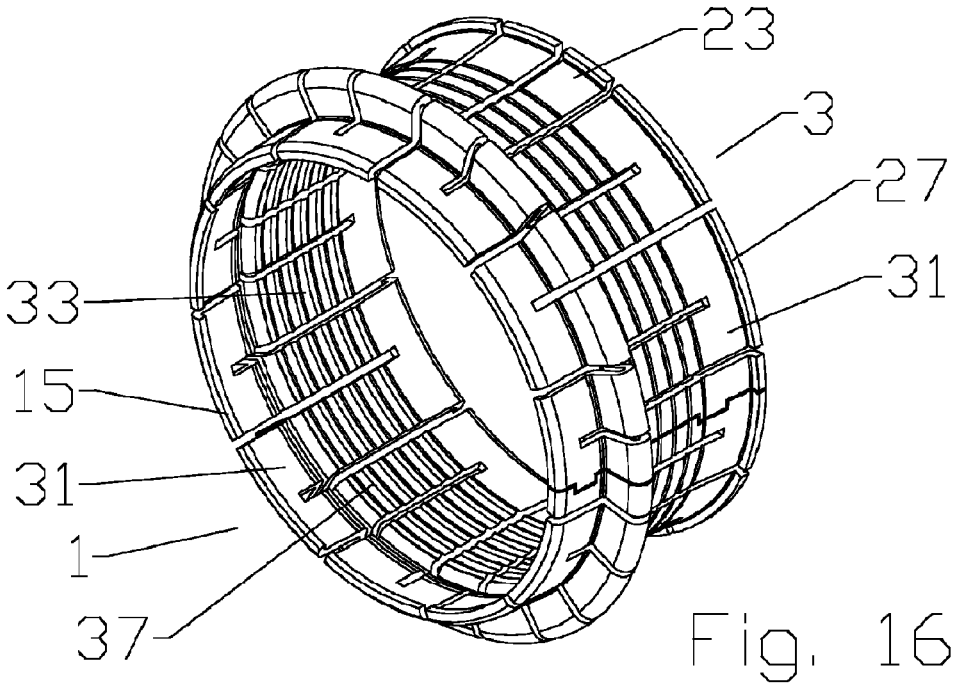
FIG. 16 is a schematic isometric view of a fourth embodiment of a grip ring.
Figure 17:
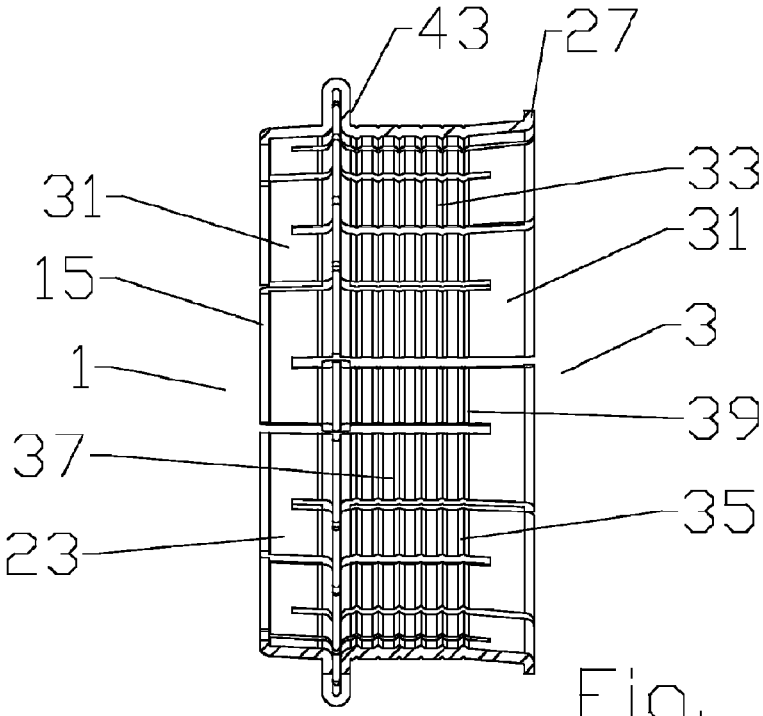
FIG. 17 is a schematic cut-away side view of FIG. 16.
Figure 24:
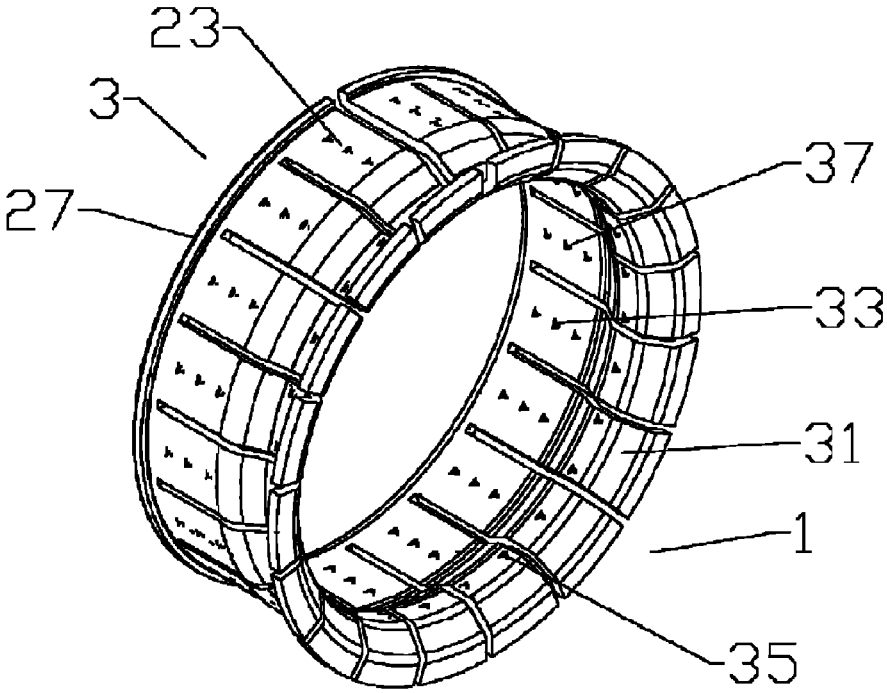
FIG. 24 is a schematic isometric view of an alternative grip ring.
Figure 25:
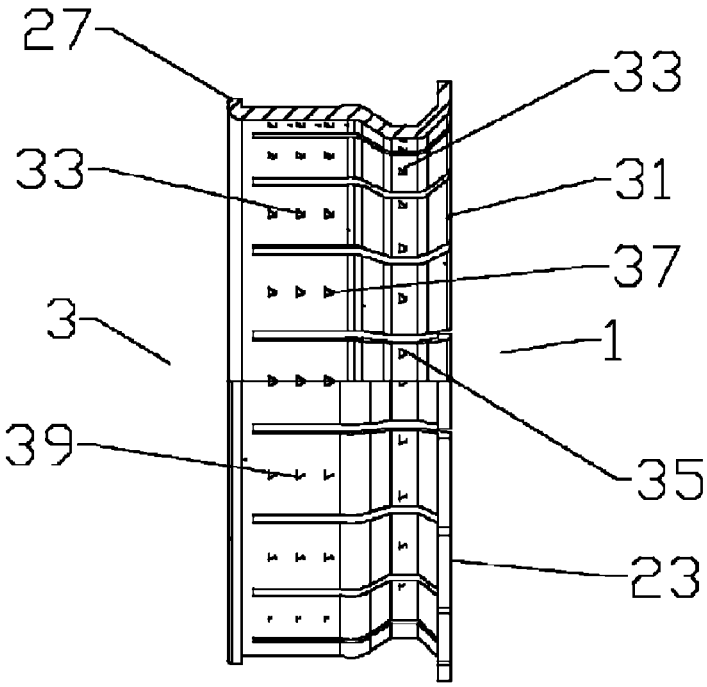
FIG. 25 is a schematic 90 degree cut-away side view of FIG. 24.

Embodiments wherein the coupling body 19 threads over the connector body, for example as shown in FIGS. 20-23, may also be utilized. The grip ring 23 may be arranged to seat also upon the jacket 59 of the coaxial cable, further distributing the grip surface 33 to engage both the outer conductor 17 and the jacket 59.

Where the stamped and rolled type grip ring 23 is applied, the grip surface 33 may be cost effectively formed via stamping partially through the material, for example as shown in FIGS. 16 and 17, in an annular barb configuration, or alternatively as a plurality of wedge shapes with the insertion surface 39 rising from a wide base to a stop surface 37 at the connector end 1, for example as shown in FIGS. 24 and 25.

Although the disclosed embodiments are particularly suited for smooth wall solid outer conductor cable, these may also be applied to other solid outer conductor configurations, such as annular corrugated solid outer conductor. An annular corrugated solid outer conductor coaxial cable may be prepared by cutting the end at a corrugation peak, which positions the coaxial cable to present a corrugation peak for the sealing gasket to be compressed against and enables the leading edge of the outer conductor to seat against the grip ring lip.

One skilled in the art will appreciate that providing the grip ring 23 pre-attached to the coupling body 19, with the compression body 25 protected between the grip ring 23 and the coupling body 19, may significantly decrease the chances for loosing separate elements of the connector prior to assembly and/or improper assembly.

Table of Parts

| | |
|---|---|
| 1 | connector end |
| 3 | cable end |
| 5 | coaxial connector |
| 7 | connector body |
| 9 | connector body bore |
| 11 | spring contact |
| 13 | spring contact groove |
| 15 | cable stop |
| 17 | outer conductor |
| 19 | coupling body |
| 21 | coupling body bore |
| 23 | grip ring |
| 25 | compression body |
| 26 | compression surface |
| 27 | coupling shoulder |
| 29 | retention groove |
| 31 | coupling spring finger |
| 33 | grip surface |
| 35 | barb |
| 37 | stop surface |
| 39 | insertion surface |
| 41 | compression sidewall |
| 43 | compression body shoulder |
| 45 | positive stop |
| 47 | thread |
| 49 | gasket |
| 51 | gasket shoulder |
| 57 | washer |
| 59 | jacket |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept.

Further, it is to be appreciated that improvements and/or modifications may be made thereto without departing from the scope or spirit of the present invention as defined by the following claims.

We claim:

1. A coaxial connector for use with a coaxial cable with an outer conductor, comprising:

a connector body provided with a connector body bore;

a coupling body provided with a coupling body bore;

a compression sidewall of the connector body bore provided with an increasing diameter towards a cable end of the connector body;

a grip ring seated within the coupling body bore, provided with a plurality of coupling spring fingers extending towards a connector end of the grip ring, an inner diameter of the coupling spring fingers provided with a grip surface;

an inward projecting cable stop provided at a connector end of the coupling spring fingers; and an annular compression body seated on an outer diameter of the grip ring between a compression surface of the coupling body and an upward projecting compression body shoulder of the coupling spring fingers;

the connector body and the coupling body coupled together via threads;

the grip ring dimensioned for axial advancement of the coupling body along the threads to drive the compression body against the compression shoulder and the coupling spring fingers against the compression sidewall to exert a compression force radially inward upon the outer diameter of the outer conductor seated in the coupling body bore abutting the cable stop.

2. The coaxial connector of claim 1, further including a surface to surface positive stop between the coupling body and the connector body that stops the compression force at a predetermined maximum torque by preventing further movement of the coupling body towards the connector body.

3. The coaxial connector of claim 1, wherein the grip ring is retained within the connector body bore by an outward projecting coupling shoulder at a cable end of the grip ring, the coupling shoulder seated within a retention groove of the coupling body.

4. The coaxial connector of claim 1, further including a spring contact seated in a spring contact groove provided in the inner diameter of the coupling spring fingers, the spring contact dimensioned to engage the outer diameter of the outer conductor.

5. The coaxial connector of claim 1, wherein the grip surface is a plurality of annular barbs.

6. The coaxial connector of claim 5, wherein the annular barbs have a stop surface at a connector end and an insertion surface at a cable end; the stop surface provided normal to a longitudinal axis and a diameter of the insertion surface increasing towards the connector end.

7. The coaxial connector of claim 1, further including a washer between the compression surface and the compression body.

8. The coaxial connector of claim 1, wherein the compression body is a helical coil spring ring.

9. The coaxial connector of claim 1, further including a sealing gasket seated between a cable end of the grip ring and an inward projecting sealing gasket shoulder of the coupling body bore.

10. A coaxial connector for use with a coaxial cable with an outer conductor, comprising:

a connector body provided with a connector body bore;

a coupling body provided with a coupling body bore;

a compression sidewall of the coupling body bore provided with a decreasing diameter towards a cable end;

a grip ring seated within the coupling body bore, provided with a plurality of coupling spring fingers extending towards the cable end, an inner diameter of the coupling spring fingers provided with a grip surface;

the grip ring provided with an inward projecting cable stop at a connector end; and the connector body and the coupling body coupled together via threads;

the grip ring dimensioned for axial advancement of the coupling body along the threads to drive the compression sidewall against the coupling spring fingers to exert a compression force radially inward upon the outer diameter of the outer conductor seated in the coupling body bore abutting the cable stop.

11. The coaxial connector of claim 10, further including a surface to surface positive stop between the clamp nut and the connector body that stops the compression force at a predetermined maximum torque by preventing further movement of the clamp nut towards the connector body.

12. The coaxial connector of claim 10, wherein the grip ring is retained within the connector body bore by an outward projecting shoulder at the cable end seated within an annular retaining groove of the coupling body, the compression sidewall provided as the bottom of the retaining groove.

13. The coaxial connector of claim 10, further including an annular compression body seated on an outer diameter of the grip ring between a compression surface of the coupling body and an upward projecting compression body shoulder of the coupling spring fingers.

14. The coaxial connector of claim 13, further including a washer between the compression surface and the compression body.

15. A coaxial connector for use with a coaxial cable with an outer conductor, comprising:

a connector body provided with a connector body bore;

a coupling body provided with a coupling body bore;

a compression sidewall of the coupling body bore provided with a decreasing diameter towards a cable end;

a grip ring seated within the coupling body bore, provided with a plurality of slots extending from the cable end and a connector end to define coupling spring fingers extending towards the cable end and a connector end, an inner diameter of the coupling spring fingers provided with a grip surface;

the grip ring provided with an inward projecting cable stop at the connector end; and the connector body and the coupling body coupled together via threads;

the grip ring dimensioned for axial advancement of the coupling body along the threads to drive the compression sidewall against the coupling spring fingers to exert a compression force radially inward upon the outer diameter of the outer conductor seated in the coupling body bore abutting the cable stop.

16. The coaxial connector of claim 15, wherein the coupling spring fingers extending towards the cable end and the coupling spring fingers extending towards the connector end are interlaced with one another.

17. The coaxial connector of claim 15, further including an annular compression body seated on an outer diameter of the grip ring between a compression surface of the coupling body and an upward projecting compression body shoulder of the coupling spring fingers.

18. The coaxial connector of claim 17, further including a washer between the compression surface and the compression body.

19. The coaxial connector of claim 15, further including a surface to surface positive stop between the clamp nut and the connector body that stops the compression force at a predetermined maximum torque by preventing further movement of the clamp nut towards the connector body.

20. The coaxial connector of claim 15, further including a compression sidewall of the connector body provided with an increasing diameter towards the cable end, the grip ring contacting the compression sidewall of the connector body during axial advance, also applying the compression force radially inward upon the outer diameter of the outer conductor seated in the coupling body bore abutting the cable stop.

* * * * *